United States Patent [19]

Worth

[11] 3,993,393

[45] Nov. 23, 1976

[54] ROUND CONDUCTOR FLATCABLE CONNECTOR

[75] Inventor: Sidney V. Worth, Flourtown, Pa.

[73] Assignee: Continental-Wirt Electronics Corporation, Warminster, Pa.

[22] Filed: Oct. 8, 1975

[21] Appl. No.: 620,573

[52] U.S. Cl. ..... 339/99 R
[51] Int. Cl.[2] ..... H01R 9/08
[58] Field of Search ..... 339/97–99

[56] References Cited

UNITED STATES PATENTS

| | | | |
|---|---|---|---|
| 3,820,058 | 6/1974 | Friend | 339/99 R |
| 3,858,159 | 12/1974 | Worth | 339/99 R |

*Primary Examiner*—Joseph H. McGlynn
*Attorney, Agent, or Firm*—Edelson and Udell

[57] ABSTRACT

A pierce-type contact element for use with a connector for a multi-conductor flat cable having a plurality of parallel insulated round wire conductors, each contact element having a circuit connecting terminal and a bifurcated part nested within the connector. The bifurcated part provides a pair of sharply pointed tines the opposed inner edges of which are spaced apart a distance less than the diameter of the wire conductor and act to slice through the conductor insulation to electrically engage opposite sides of the conductor wire. The tines are reversely bent to provide the same with parallel portions which are offset from one another along the longitudinal axis of the insulated conductor. The opposed inner edges of the tines are provided with sharply cornered cutting edges which respectively bite into and make contact with opposite sides of the conductor wire at two points spaced lengthwise of the wire. The parallel relatively offset portions of the tines of the contact element place the conductor under tension in the region of its connection to the contact element, the force of which tension serves to hold the contact element in secure electrical connection with the conductor.

13 Claims, 8 Drawing Figures

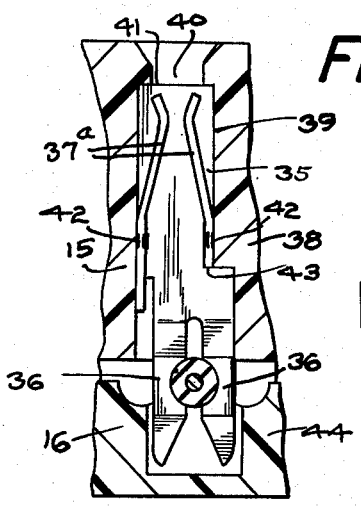
FIG. 8
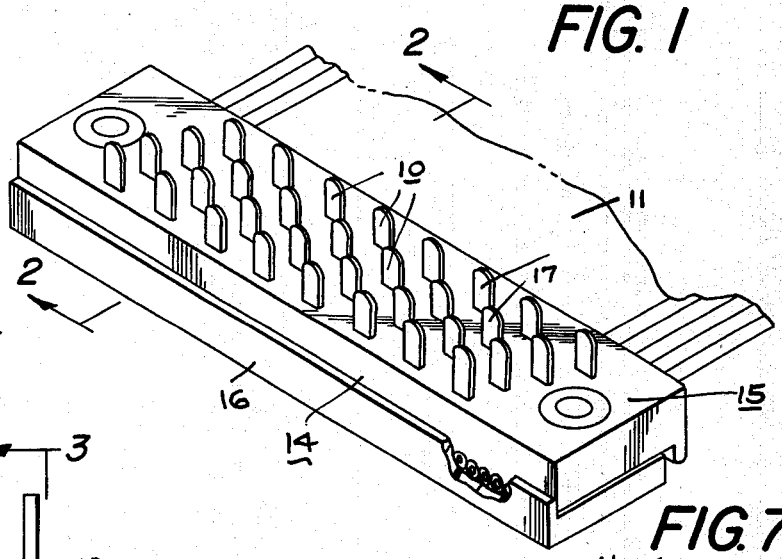
FIG. 1
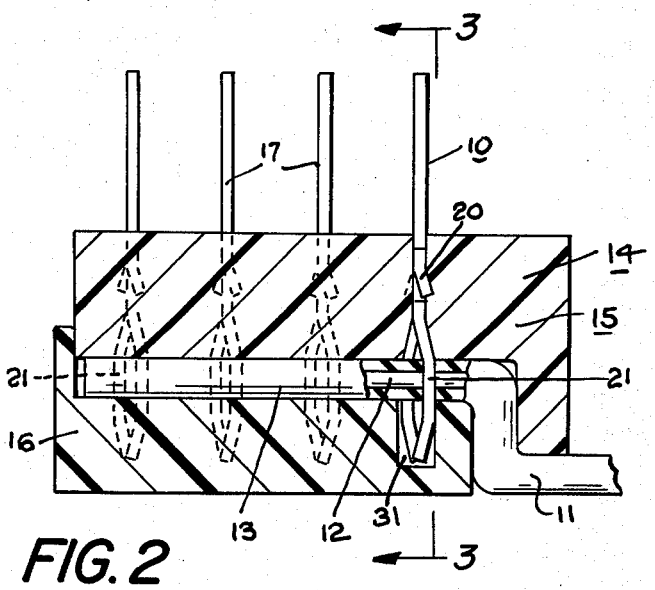
FIG. 2
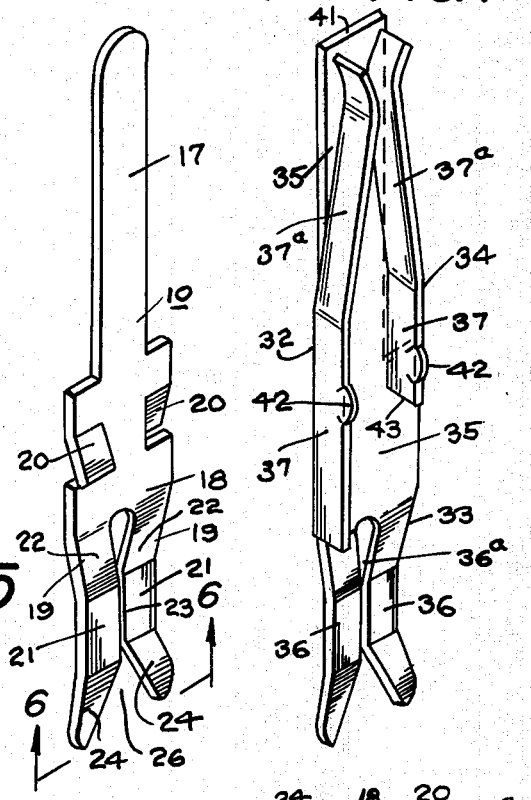
FIG. 7
FIG. 5
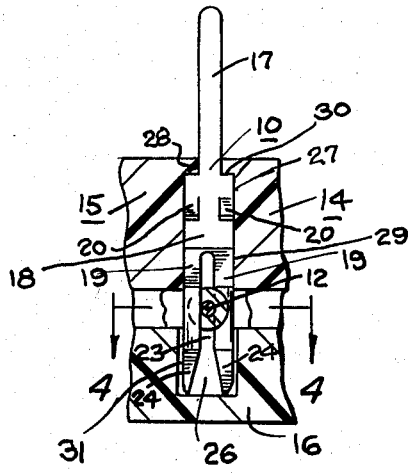
FIG. 3
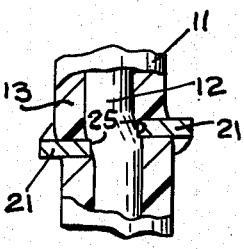
FIG. 4
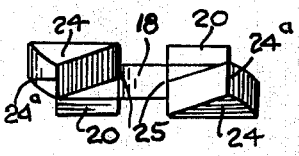
FIG. 6

ROUND CONDUCTOR FLATCABLE CONNECTOR

This invention relates generally to electrical connectors and more particularly to an improved construction of pierce-type bifurcated contact terminals for multiple conductor insulated cables in the form of flat tapes having a plurality of longitudinally extending parallel insulated wire conductors secured together in a common plane by an enveloping film of plastic or other penetrable dielectric material. A form of pierce-type contact terminal is shown in my prior U.S. Pat. No. 3,858.159 which also discloses a connector assembly for holding a number of such terminals in secured electrical connection with selected conductors of the cable.

In my said prior patent, the inner edges of the bifurcated contact tines are provided with diagonally opposed sharp cutting corners which bite into the conductor wire at two points offset from one another lengthwise of the wire and so impart a bend thereto to thereby place it under tension in the immediate region of its engagement by said tines. This offset disposition of the opposed cutting corners of the contact tines relatively to the conductor wire axis is effected by providing the bifurcated part of the contact with a twist which is angularly related to said axis while at the same time the two piercing tines of the contact are disposed in coplanar relation. Thus, for maximum "biting" of the contact prongs of my prior patented construction into the conductor wire at offset points thereof, the twist of the bifurcated part of the contact as well as the coplanar disposition of the piercing tines must be maintained upon projection of the tines through the insulation of the conductor wire to be engaged by the contact, since otherwise there may be no such secure engagement with the wire as would place it under the above-mentioned desired tension.

Among the objects of the present invention is to provide an improved construction of a bifurcated contact member of the character aforesaid wherein the bifurcated tines are respectively shaped so as to provide the same with laterally offset, parallel sections having opposed sharply cornered inner edges which are spaced apart a distance slightly less than the diameter of the conductor wire with which it is engaged so that upon projection of the spaced tines through the conductor insulation in straddling relation to the conductor wire these inner sharply cornered edges of the tines act as in my prior patented construction of the contact to place the clinched conductor under tension in the region of its connection to the contact, thereby insuring a mechanically secure connection of low resistance between each contact and its associated conductor of the flat cable tape.

An important object of the present invention is not only to increase the "biting" force of the contact tines on the conductor wire but also to insure that such force is effectively maintained to hold the contact in secure electrical engagement with the wire.

A further object is to reduce the cost of manufacture of the contact by eliminating the special tooling and manufacturing operations which are required for twisting the bifurcated portion of the contact out of the plane of its base portion as in the construction of the contact of my above mentioned U.S. Pat. No. 3,858,159.

Still another object is to provide a contact of the character described wherein the kerf which defines the inner wire-engaging edges of the contact tines is of such reduced uniform width relatively to the diameter of its engaged conductor wire that any tendency of the tines to spread apart during the operation of attaching the contact to the conductor wire is reduced, thereby insuring maximum constraint against separation of the tines for imparting thereto a high wire-penetrating force which reacts against the restrained tendency of the conductor wire to assume its straightened condition.

Other objects and advantages of the present invention will appear more fully hereinafter, it being understood that the invention consists substantially in the combination, construction, location and relative arrangement of parts, all as described in detail in the following specification, as shown in the accompanying drawings and as finally pointed out in the appended claims.

In the accompanying drawings:

FIG. 1 is a perspective view showing a connector having a plurality of contacts of the present invention attached to one transversely cut-end of a flat multiple conductor cable;

FIG. 2 is a greatly enlarged transverse cross-sectional view of the cable-attached connector as taken along the line 2—2 of FIG. 1;

FIG. 3 is a longitudinal sectional view of a portion of the cable-attached connector as taken along the line 3—3 of FIG. 2;

FIG. 4 is an enlarged partial sectional view as taken along the line 4—4 of FIG. 3;

FIG. 5 is a perspective view, greatly enlarged, of a contact element as constructed in accordance with and embodying the principles of the present invention;

FIG. 6 is an enlarged bottom end view of the contact as seen from the line 6—6 of FIG. 5;

FIG. 7 is a perspective view of a modified form of the connector contact element of the present invention; and FIG. 8 is a sectional view similar to that of FIG. 3 but showing the modified form of contact shown in FIG. 7.

Referring now more particularly to the drawings it will be observed that the contact of the present invention, designated generally by the reference numeral 10, is shown applied to a flat multi-conductor cable 11 of the type which includes a plurality of longitudinally extending parallel conductor wires 12 having insulation coverings 13 secured together in a common plane by an enveloping film of plastic, such as polyester or other penetrable dielectric material. The contacts 10 are respectively applied to selected conductors of the cable by way of a connector assembly 14 which is clamped to the insulated multi-wire cable 11 cross-wise thereof.

This connector assembly, which is generally similar to that disclosed in my above-mentioned prior U.S. Pat. No. 3,858,159, includes an elongated contact supporting base plate 15 molded or otherwise formed of plastic or other suitable insulating material which overlies one face of the flat insulated cable and a mating cover plate 16, preferably but not necessarily formed of the same insulating material as that of the base plate, which overlies the the opposite face of the cable. The base plate 15 supports a plurality of the contact elements 10 (such as are best shown in FIGS. 5 and 7) which are respectively mechanically and electrically connected to the several conductor wires 12 of the cable to which the connector is clamped.

As shown in FIGS. 5 and 7, the contact elements 10 are typically formed as stampings from a relatively thin but suitably hard and durable sheet metal, such as beryllium copper or phosphor bronze. Preferably, the thickness of the stamped contact element is on the order of 0.012 inch but this thickness may vary within a range of from 0.008 to 0.020 inch as may be required for a particular gauge of the conductor wire present in the insulated cable. The contact elements 10 are generally fork-shaped, each having an elongated terminal stem or nose part 17 terminating in a bifurcated tail part 18 to provide a pair of laterally spaced sharply pointed tines 19—19 which are conjointly adapted to pierce the cable insulation of an individual conductor and cut into and pinch therebetween the wire of the conductor. The nose part 17 of the contact may be of any suitable shape as may be required to serve as a terminal for connection to a printed circuit or other electrical circuit or component. Although the terminal 17 is shown elongated for projection externally of the connector 14 (as see FIGS. 1 to 5), it may be of a form and shape designed to be housed internally of the connector 10 (as see FIGS. 7 and 8).

In the form of the contact element shown in FIGS. 1 to 5, the tail part 18 thereof is notched or lanced to respectively provide its opposite side edges with tabs 20—20 which are reversely bent out of the plane of said part 18 to serve as will appear hereinafter as a means for frictionally retaining the contact elements in the base plate 15 of the connector during the operation of fixedly anchoring the contact to the wire conductors of the cable clamped in the connector.

As most clearly appears in FIG. 7 the tines 19—19 of the bifurcated tail part 18 of the contact 10 are respectively bent out of coplanar relation to provide the tines with intermediate sections 21—21 respectively disposed in parallel planes extending normal to the longitudinal axis of the conductor but offset from one another lengthwise of said axis. To effect this relationship of the intermediate wire engaging sections 21—21 of the tines the latter are initially respectively reversely bent out of their common base part 18 to form the upper sections 22—22 which define therebetween the closed upper and of the kerf 23. These tine upper sections 22—22 are themselves respectively reversely bent to form the above mentioned parallel and relatively offset intermediate wire engaging sections 21—21, which latter are in turn respectively reversely bent to form the sharply pointed insulation-piercing end portions 24—24 of the tines. It will be noted that these end portions 24—24 of the tines are so angularly related as to aline their insulation piercing points 24$^a$—24$^a$ in the plane of the base part 18 of the contact, which plane extends normal to the axis of the conductor engaged by the contact. It will be noted also that the inner edges of at least the conductor-engaging intermediate sections 21—21 are squared off to provide the same with sharp right angular corners, as at 25—25 best shown in FIG. 4, which corners are offset from one another along the longitudinal axis of the conductor engaged by the contact.

The kerf 23 defined by the inner edges of the tines 19—19 is of a generally uniform width throughout its extent as measured in the plane of the contact base part 18 which is somewhat less than the diameter of the wire straddled by the contact tines, so that when the contact is forcibly engaged with the conductor the sharp corners 25—25 bite into the conductor wire at points spaced lengthwise thereof to thereby impart such twist or kink in the conductor in the immediate region of the clinched connection as to place it under tension in that region. There is thus established a force on each conductor which reacts as it tends to remain straight (due to the close adjacency and parallel relationship of the several conductors of the cable which tends to keep them individually straight) to maintain the contact tines tightly closed against the conductor wire, thereby effecting a mechanically secure and low resistance connection between the conductor and its associated contact.

Although the above mentioned kerf width of the contact for a given contact must be less than the diameter of the wire engaged by the contact, the offset spacing of the parallel wire-engaging sections 21—21 of the contact tines is not so critical and may be varied within reasonable limits. To facilitate piercing of the contact through the cable insulation for engagement with a selected conductor of the cable, the inner edges of the alined pointed extremities 24—24 of the contact tines diverge from one another, as at 26, to provide a flared entrance for insertion of the conductor into the kerf of the contact.

The contacts as formed as above described are initially inserted with their flat terminal stems or nose parts 17 extending foremost into a plurality of internally stepped slits 27 respectively provided therefor in the base plate 15 of the connector assembly 14. As most clearly appears in FIGS. 1 to 3 these slits 27 are disposed in edgewise spaced relation along one or more rows thereof extending lengthwise of the connector base plate 15, i.e., transversely across the width of the cable clamped in the connector. Each of said slits 27 is provided with a narrow upper section 28 which opens through the top of the base plate 15 and is of a dimension to more or less snugly receive therein the terminal stem 17 of one of said contact elements and with a wider bottom section 29 which opens through the bottom of the base plate and is of an enlarged dimension sufficient to accommodate therein the base part 18 of the bifurcated contact. The two sections 28 and 29 of each slit 27, which are in communication with each other, thus conjointly extend through the full depth of the base plate and provide each slit 27 intermediate its opposite open ends with an internal shoulder 30 which is engageable by the relatively wide base part 18 of the contact to limit the extent to which its terminal stem 17 projects externally of the slitted top surface of the connector base plate 14. The several contact elements are respectively frictionally held in the slits 27 formed in the base plate 15 by the retaining tabs 20—20 (see FIG. 2).

With the contacts fully inserted into their respective slits formed in the base plate 15, it will be observed, as best shown in FIGS. 2 and 3, that the end portions of the cable piercing tines of the contacts all project freely beyond the bottom surface of the base plate 15, and thus are in position to slice through the insulation of the cable for mechanical and electrical engagement with the wire conductors thereof substantially in accordance with the procedure described in my aforesaid U.S. Pat. No. 3,858,159.

Also, as in the construction of my aforesaid patent, the bottom surface of the base plate 15 through which the cable-pierctines 19—19 of the contact members project is centrally channeled or recessed to a depth less than the overall thickness of the cable so that when it is laid in the recess its bottom portion projects externally of the recess while at the same time the cable itself is held against sidewise shift by shoulders formed at opposite ends of the recess. The spacing of the contact-receiving slits 27 within the recessed portion of the base plate 15 is of course such that when the cable is laid into its recess the cable-piercing tines 19—19 of the several contact members nested in the slits 27 are respectively disposed in straddling relation to the several conductors of the cable, i.e., with the tines of each contact member disposed generally in perpendicular relation to the flat plane of the cable.

As has been indicated, the connector may be provided with one or more rows of "in-line" contact members depending upon number and spacing of the conductor wires contained in the flat insulated cable. FIG. 1 illustrates a connector having four such rows of contact members, and in which the contact members of one row are staggered with respect to those of its next adjacent row, thereby permitting a given conductor to have a high density of cable-connected members per unit length of the connector.

Securement of the several insulated conductors of the flat cable respectively to the contact members of the connector is preferably effected by use of the cover plate 15 in the following manner. This cover plate 15 is provided in the surface thereof which underlies the cable-receiving recess of the base plate 15 with a plurality of parallel arcuately shaped grooves as shown and described in my aforesaid patent suitably spaced along the length of the cover plate to respectively accomodate therein the several insulated conductors of the cable 11 in such manner that when the base and cover plates are secured together the cable is effectively clamped therebetween. Also provided in the cover plate 15 are a plurality of cavities 31, one for each of the contact elements 10, which extend crosswise of the said grooves for vertical registry respectively with the slits 27 of the base plate 15. Each of these cavities 31 is of a rectangular outline and so dimensioned as to freely receive therein the freely projecting end portions of the cable-piercing tines 19—19 of each contact member 10 nested in a slit 27 of the base plate 15.

Upon securing the cover plate 15 flatwise against the base plate 14 to thereby clamp the cable therebetween, the pointed tines 19—19 of the contact members nested in the base plate as aforesaid simultaneously slice through opposite sides of the insulation of each of the cable conductors to an extent sufficient to cause the sharp corners 25—25 of the tine sections 21—21 to cut into the conductor wire itself.

The tines 19—19 of each contact member 10 thus straddle and effectively mechanically and electrically engage therebetween the conductor wire 12 which is to be connected to each contact member. This mechanically secure and low resistance connection between each of the cable conductor and its contact member is effectively maintained by the offset relation of the tine section 21—21 relatively to the axis of the conductor, thereby to impart as hereinbefore mentioned such twist or kink in the conductor in the immediate region of its connection with the contact as to place it under tension in that region, and so establish a force which reacts as the conductor tends to straighten out to maintain the contact tines 19—19 tightly closed against the conductor wire.

FIGS. 7 and 8 show a modified construction of a contact 32 embodying the principles of the present invention. This modified form of the contact is provided with a bifurcated tail part 33 which in all material respects is functionally and structurally the same as the corresponding part of the previously described contact shown in FIGS. 1 to 6. However, its nose part 34 is different in that it is formed to receive a circuit connecting pin or post. To this end, the nose part 34 includes an elongated flat base part 35 which extends upwardly well beyond the closed end of the kerf 36$^a$ in a plane which is disposed between and parallels the intermediate offset and parallel sections 36—36 of the contact tines. The flat base part 35 is provided at its opposite sides with elongated side wall parts or flanges 37 the upper portions of which are respectively reversely curved as shown to provide a pair of spring leaf fingers 37$^a$—37$^a$ which coact with the upper portion of the flat base part 35 to provide in effect a three-walled socket for reception of a circuit-connecting pin (not shown). The spring fingers 37$^a$—37$^a$ are resiliently biased toward one another for contact with diametrically opposite sides of the pin inserted therebetween.

As in the case of the previously described male type contact 10, the female type contacts 32 are mounted in a connector base plate 38 having formed therein cavities 39 suitably shaped to accomodate the contact noze parts 34. The upper ends of these cavities terminate in suitably flared openings 40 of reduced size for entering the circuit-connecting pins into the socketed noze parts of the contacts, it being noted that the upper extremities of the resilient pin-engaging finers 37—37 terminate just short of the top end 41 of the base wall part 35 of the contact nose part 34, which top end 41 serves as a stop to limit upward movement of the contact in its receiving cavity and that one or both of the edges of the side flanges 36 of the contact nose part 34 is provided with a bump or protrusion 42 which engages a wall of the cavity to frictionally hold the contact in secured position within the connector base plate 38. Preferably, one of the side flanges 37 is inturned from the base wall part 35 of the contact 32 to shorten the same and provide it with a shoulder 43 which may be engaged by a suitable tool to press the contact inwardly into its fully seated position in its accomodating cavity 35. The bifurcated tines which penetrate the cable insulation and bite into the conductor wire project into cavities suitably provided in a connector cover plate 44 which is secured to the connector base plate to complete the connector assembly for the insulated multiple conductor cable.

It will be noted that when the contact members of the present invention are respectively staked to the wire conductors of the flat cable as hereinbefore described, they remain anchored to the cable despite any loosening or even complete separation of the connector plates from one another.

It will be apparent that other means and methods may be employed for respectively connecting the several contact members to the several conductors of the flat cable, such as by use of a press (not shown) which might include a bottom platen having grooves and cavities corresponding to those of the connector cover plate for accommodating the cable conductors and the freely projecting tine portions of the contact members nested in the connector base plate during the operation of attaching the contacts to their conductors. Thereafter, it would only be necessary to secure the cover plate to the base plate in covering relation to the cable by any suitable means.

It will be apparent also that various modifications and variations may be made from time to time without departing from the essential principles or real spirit of the invention and accordingly it is intended to claim the same broadly, as well as specifically, as indicated by the appended claims.

What is claimed as new and useful is:

1. An electrical contact element for connection to an insulated round wire conductor of a multi-conductor flat cable comprising a stamping of thin sheet metal having a flat base part integrally provided at one end thereof with a pair of freely extending sharply pointed tines adapted to pierce the conductor insulation crosswise of the conductor, said tines being oppositely bent out of the plane of said base part and individually bent to respectively provide the same with angularly related upper and lower portions bridged by flat central portions disposed in parallel planes respectively offset to either side of the plane of said base part, said upper portions of said tines being respectively integrally connected to said base part of said contact element and said lower portions of said tines being respectively provided with freely extending sharply pointed insulation-piercing extremities which converge toward each other to commonly present their points in said plane of said base part, the opposed inner edges of at least said central portions of the tines as measured in a flat plane paralleling said parallel planes being uniformly spaced apart a distance less than the diameter of the conductor engaged thereby and respectively provided with sharp cutting corners which engage and cut into diametrically opposite sides of the conductor wire at two points relatively offset from one another along the longitudinal axis of the conductor wire for imparting a bending moment thereto whereby to place the latter under tension in the region of its engagement by said tines and thereby establish a force which reacts against the restrained tendency of the conductor to assume a straightened condition.

2. A contact element as defined in claim 1 wherein said inner edges of the central portions of said tines are disposed in parallel planes extending lengthwise of the conductor engaged by said contact element.

3. A contact element as defined in claim 1 wherein the spatial distance between said sharp cutting corners of said inner edges of said flat central portions of said tines is uniform throughout the lengths of said inner edges as measured both diametrically and along the axis of the conductor wire engaged by the contact element.

4. An electrical connector as defined in claim 1 wherein said upper and lower portions of one of said pair of tines are respectively bent oppositely from the bends of the corresponding portions of the other of said pair of tines whereby to dispose the central portions of said tines in mutually offset relation.

5. A contact element as defined in claim 1 wherein said flat base part thereof is provided with means extending oppositely from said sharply pointed piercing tines for connecting said contact element to an element of an electrical circuit or component thereof.

6. A contact element as defined in claim 5 wherein said means is in the form of an elongated flat strip which is integral with and disposed in coplanar relation to said base part of said contact element.

7. An electrical connector for an insulated flat cable having a plurality of insulated round wire conductors disposed in coplanar side by side relation within an enveloping film of insulating material comprising an insulated structure secured to the cable in transversely extending relation to the conductors thereof, said structure having a plurality of sets of alined recesses respectively extending above and below the plane of the cable in registry with the conductors thereof, and a plurality of pierce-type conductor-engaging contact elements respectively nested in selected sets of said alined recesses for piercing the cable insulation and engaging the cable conductors in registry with said sets of recesses, each said contact element having a pair of cable-insulation-piercing tines which project into a recess below said cable plane in straddling relation to a conductor of said cable, the conductor-straddling tines of each said contact element having flat central portions respectively disposed in parallel planes which extend at right angles to the conductor wire and are relatively offset from one another lengthwise of the conductor wire engaged thereby and have opposed sharply cornered inner edges which define a conductor-embracing kerf therebetween of a uniform width throughout the effective length of said edges less than the diameter of said conductor wire as measured in a plane paralleling said parallel planes whereby said sharply cornered inner edges of said tines engage and bite into the conductor wire at two points relatively offset from one another along the axis of said conductor wire and impart thereto a bending moment which places the same under tension in the region of its engagement by said tines to thereby establish a force which reacts against the restrained tendency of the conductor wire to assume a straightened condition, said offset flat portions of said conductor-straddling tines respectively terminating in sharply pointed cable-piercing ends which are respectively oppositely bent out of the parallel planes of said flat portions for disposition of said pointed ends in a common plane substantially centered between said parallel planes.

8. An electrical connector as defined in claim 7 wherein said cable-piercing pointed ends are coplanar with said base part of the contact element.

9. An electrical connector as defined in claim 7 wherein said sets of recesses each include a pair of recesses which are disposed in spaced end to end relation and extend normal to the plane of the cable, wherein a cable as aforesaid occupies the free space between said pair of recesses and is held captive in said structure, and wherein said parallel portions of the tines of each said contact element extend through the insulation of the cable held captive in said free space.

10. An electrical connector as defined in claim 9 wherein each said contact element includes a base part which is provided with means frictionally retaining the same nested in its accommodating recesses.

11. An electrical connector as defined in claim 9 wherein each said contact element includes a base part integral with the tines thereof, wherein said base part is nested in that one of said pair of recesses which extends above the plane of said captive cable and wherein said base part includes means for frictionally holding the contact element in substantially fixed position within said structure.

12. An electrical connector as defined in claim 11 wherein said parallel portions of said tines of each contact element are offset to either side of and parallel to the plane of said base part.

13. An electrical connector as defined in claim 11 wherein said base part of the contact element is provided with means extending oppositely from said tines for connecting said contact element into an electrical circuit or to a component thereof.

* * * * *